US005643147A

United States Patent [19]

Huang

[11] Patent Number: 5,643,147

[45] Date of Patent: Jul. 1, 1997

[54] MULTIPURPOSE EXERCISE MACHINE

[76] Inventor: Ching-Lien Huang, 2F, No. 14, Ning Hsia E. 5 St., Taichung, Taiwan

[21] Appl. No.: 654,768

[22] Filed: May 29, 1996

[51] Int. Cl.[6] ..... A63B 69/06

[52] U.S. Cl. ..... 482/72; 482/96

[58] Field of Search ..... 472/106, 108, 472/115, 111, 112; 482/96, 95, 57, 72

[56] References Cited

U.S. PATENT DOCUMENTS

| | | | |
|---|---|---|---|
| 935,854 | 10/1909 | Linrode | 472/108 |
| 5,356,357 | 10/1994 | Wang et al. | 482/96 |
| 5,429,568 | 7/1995 | Chen | 482/72 |
| 5,453,066 | 9/1995 | Richter, Jr. | 482/96 |
| 5,478,298 | 12/1995 | Chen | 482/95 |
| 5,507,710 | 4/1996 | Chen | 482/72 |
| 5,575,739 | 11/1996 | Piaget et al. | 482/51 |

OTHER PUBLICATIONS

Cardiotrainer/Weslo Users Manual Jan. 30, 1996.

*Primary Examiner*—Jerome Donnelly
*Attorney, Agent, or Firm*—Browdy and Neimark

[57] ABSTRACT

A multipurpose exercise machine comprises a main frame, a loading frame, and an operation frame. The main frame is composed of two arcuate frames separated at an interval. The loading frame intended to support the weight of an exerciser is fastened pivotally with the main frame. The loading frame is provided at one end thereof with two pedals fastened pivotally therewith. The operation frame comprises a curve rod fastened pivotally with two frame rods of the main frame, a first driving rod, and a second driving rod. The first and the second driving rods are fastened with the loading frame. The curve rod is fastened pivotally with an actuating rod. The first and the second driving rods can be adjusted such that the exercise machine can be used for the horse-riding exercise, the arm building exercise, the chest building exercise, and so forth.

7 Claims, 5 Drawing Sheets

MULTIPURPOSE EXERCISE MACHINE

FIELD OF THE INVENTION

The present invention relates generally to an exercise machine, and more particularly to a multipurpose exercise machine capable of making use of the weight of a user thereof to bring about a damping effect.

BACKGROUND OF THE INVENTION

The conventional horse-riding exercise machine is generally intended for use in strengthening or developing the hands, the feet and the hips of a person; nevertheless it is designed for use in only one purpose. In other words, the conventional horse-riding exercise machine is not designed for use in building the muscles of arms, legs, chest, etc. In addition, the conventional horse-riding exercise machine is rather bulky in size and can not be therefore stored easily.

SUMMARY OF THE INVENTION

The primary objective of the present invention is to provide a horse-riding exercise machine which is designed for building and developing the muscles of many different parts of a human body.

The foregoing objective of the present invention is attained by a multipurpose exercise machine, which comprises a main frame body, a locating frame, and an operation frame. The main frame is composed of two arcuate frames which are arranged in a parallel manner. The loading frame is intended to support the weight of an exerciser and is fastened pivotally with the main frame. The loading frame is provided at the front end thereof with two pedals fastened pivotally therewith. The operation frame comprises a curve rod fastened pivotally with two frame rods of the main frame, a first driving rod, and a second driving rod. The first driving rod and the second driving rod are fastened with the loading frame. The curve rod is fastened pivotally with an actuating rod. The first driving rod and the second driving rod can be adjusted such that the exercise machine can be used for the horse-riding exercise, the arm building exercise, the chest building exercise, the leg building exercise, etc.

The foregoing objective, features and functions of the present invention will be more readily understood upon a thoughtful deliberation of the following detailed description of the present invention in conjunction with the accompanying drawings.

DETAILED DESCRIPTION OF THE INVENTION

Figure 1:
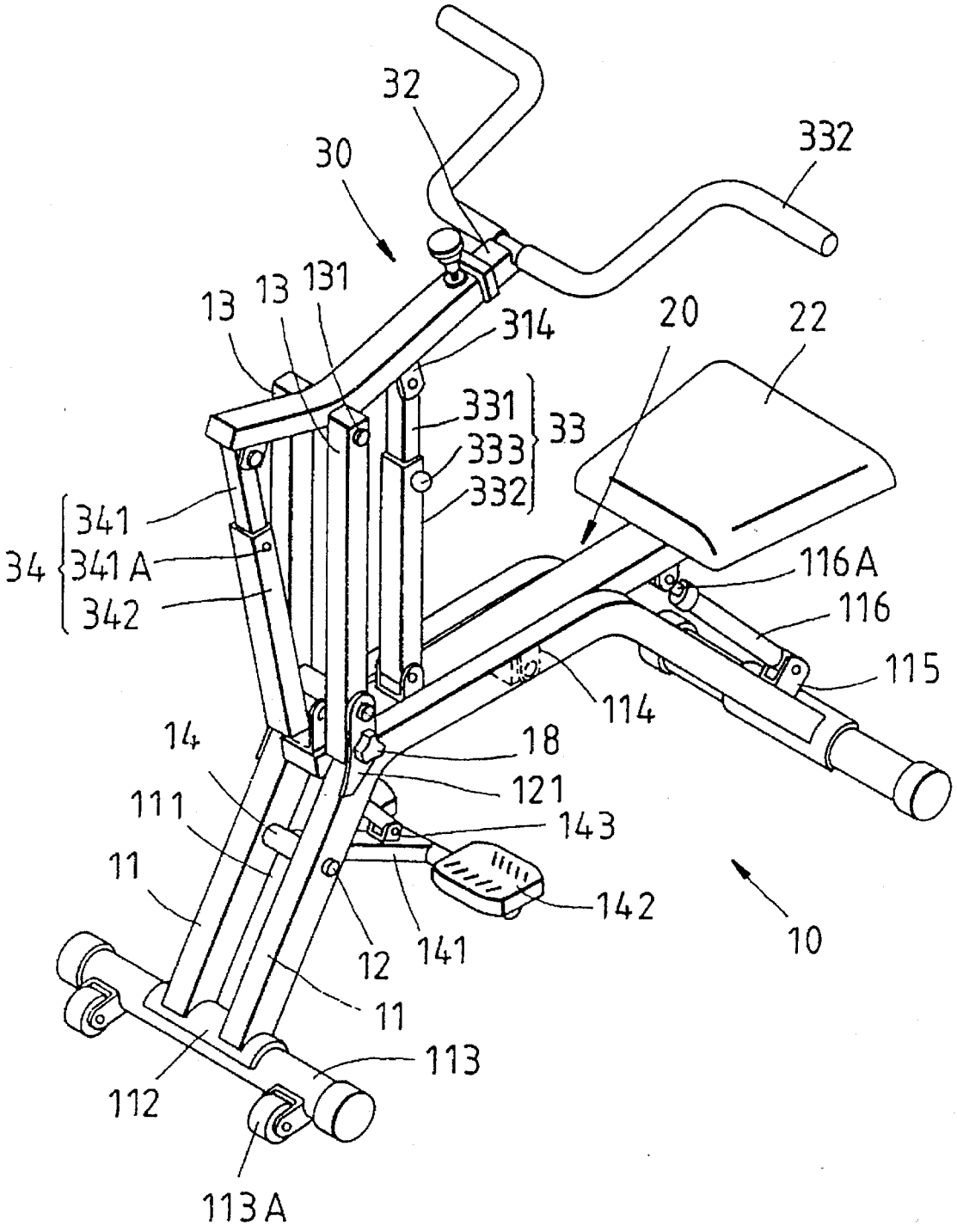
FIG. 1 shows a perspective view of the present invention in combination.
Figure 2:
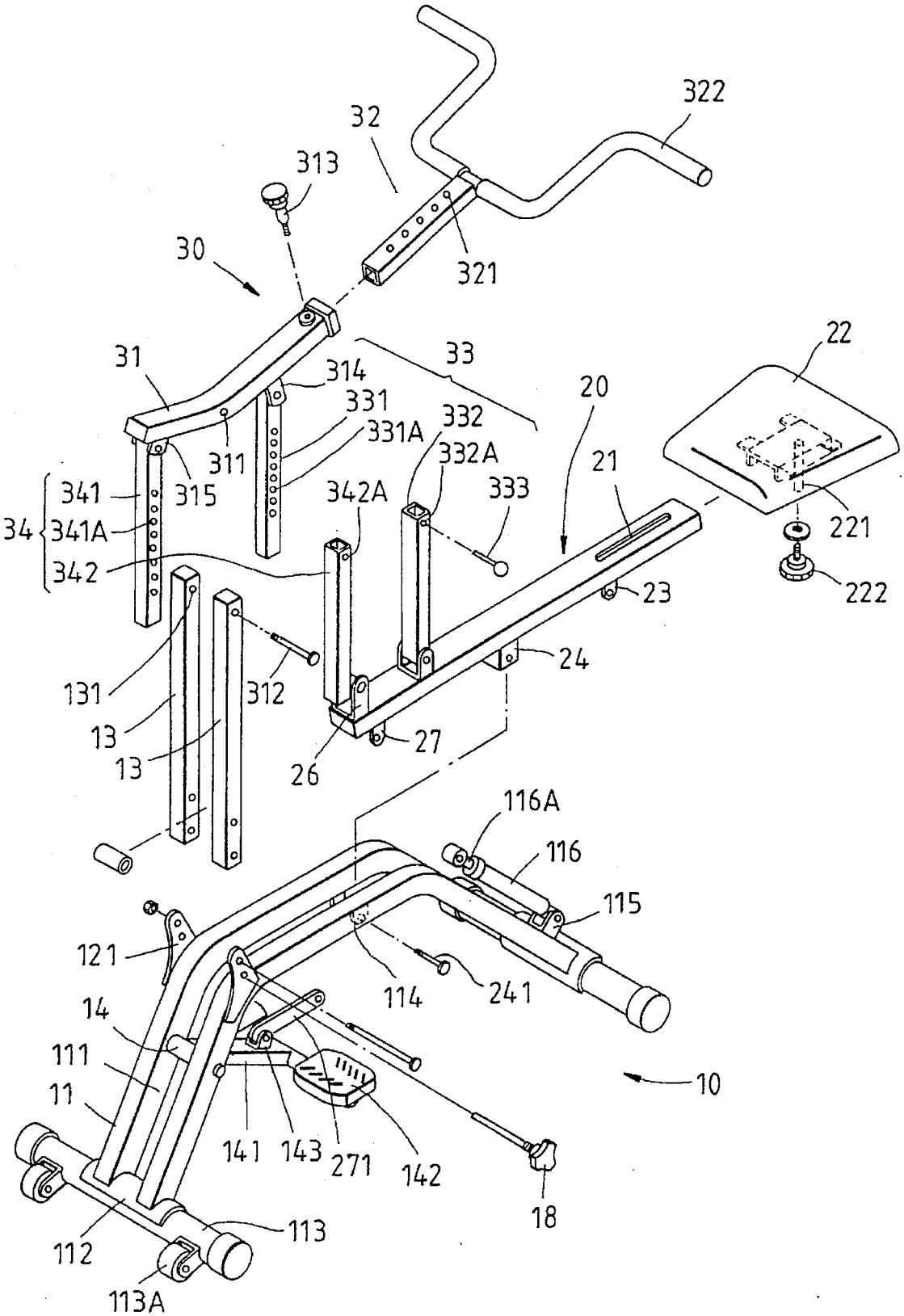
FIG. 2 shows an exploded view of the present invention.

As shown in FIGS. 1–4, an exercise machine of the present invention comprises a main frame 10, a loading frame 20, and an operation frame 30.

The main frame 10 is made up of two arcuate frames 11 which are arranged side by side such that they are parallel to each other and that they are braced by a cross rod 12 to keep the arcuate frames 11 apart at an interval 111. The arcuate frames 11 are provided at the lower ends thereof with a fastening piece 112 fastened therewith for holding a leg rod 113 by means of a plurality of screws (not shown in the drawings). The leg rod 113 has a round cross section. The leg rod 113 is provided with two casters 113A fastened therewith to facilitate the moving of the exercise machine. Located over the cross rod 12 are two fastening plates 121 which are fastened with the arcuate frames 11 by welding and are fastened pivotally with a frame rod 13 which has a pivoting hole 131 located at the top thereof. The cross rod 12 is fitted over with a rotatable sleeve 14 having integrally a connection rod 141. The free end of the connection rod 141 is fastened with two pedals 142. The connection rod 141 is provided with a pivoting lug 142 fastened therewith such that the pivoting lug 143 is contiguous to the pedals 142. The arcuate frames 11 are provided with a pivoting lug 114 fastened with the midsegments thereof, and with another pivoting lug 115 fastened with the rear segments thereof such that the pivoting lug 115 is fastened with an air cylinder set 116 having a piston rod 116A which is fastened at one end thereof with the loading frame 20.

The loading frame 20 is mounted horizontally in the interval 111 and is provided in the rear segment thereof with a slot 21. A seat 22 mounted at the rear end of the loading frame 20 is provided with a locating rod 221 which is fastened adjustably with the slot 21 by means of a nut 222. Located at the bottom of the slot 21 is a pivoting lug 23 for fastening with the piston rod 116A of the air cylinder set 116. The loading frame 20 is further provided at the midsegment thereof with a pivoting lug 24 corresponding in location to the pivoting lug 114 of the main frame 10. The pivoting lugs 24 and 114 are mounted on a shaft 241 such that they can be swiveled on the shaft 241 acting as a fulcrum. The loading frame 20 is provided at the front segment thereof with three pivoting lugs 25, 26 and 27. The pivoting lug 27 is connected by means of a connection rod 271 with the pivoting lug 143 of the connection rod 141 of the main frame 10.

The operation frame 30 is composed of a curve rod 31, an actuating rod 32, a first driving rod 33, and a second driving rod 34. The curve rod 31 is of a hollow construction and is provided at the curved portion thereof with a pivoting hole 311 receiving one end of a shaft 312 which has another end received in the pivoting hole 131 of the frame rod 13 of the main frame 10. The curve rod 31 is provided at the top thereof with a fastening screw 313 pivoted thereto for locating the actuating rod 32 which is received movably in the hollow interior of the curve rod 31. The actuating rod 32 is provided with a plurality of through holes 321 corresponding in location to and engageable with the fastening screw 313 to facilitate the adjusting of the actuating rod 32. The actuating rod 32 is fastened at one end thereof with a handle 322. The curve rod 31 is further provided with two pivoting lugs 314 and 315 fastened therewith such that they are opposite to the pivoting hole 311. The first driving rod 33 is made up of an inner tube 331 and an outer tube 332. The inner tube 331 has a plurality of through holes 331A while the outer tube 332 has a locating hole 332A engageable with a fastening pin 333 to facilitate the adjusting of the first driving rod 33. The upper and the lower ends of the first driving rod 33 are connected respectively with the pivot shaft of the pivoting lug 314 of the curve rod 31 and the pivoting lug 25 of the loading frame 20. The first driving rod 33 is intended to adjust the exercise machine for use in doing the horse-riding exercise. The second driving rod 34 is made up of an inner tube 341 and an outer tube 342. The inner tube 341 is provided with a plurality of through holes 341A while the outer tube 342 is provided with a locating hole 342A engageable with the fastening pin 333 to facilitate the adjusting of the second driving rod 34. The second driving rod 34 is intended to adjust the exercise machine for use in doing the arm-building exercise and the chest-building exercise. The second driving rod 34 is different from the first driving rod 33 in that the former is fastened at the bottom end thereof with a threaded rod by welding.

Figure 3:
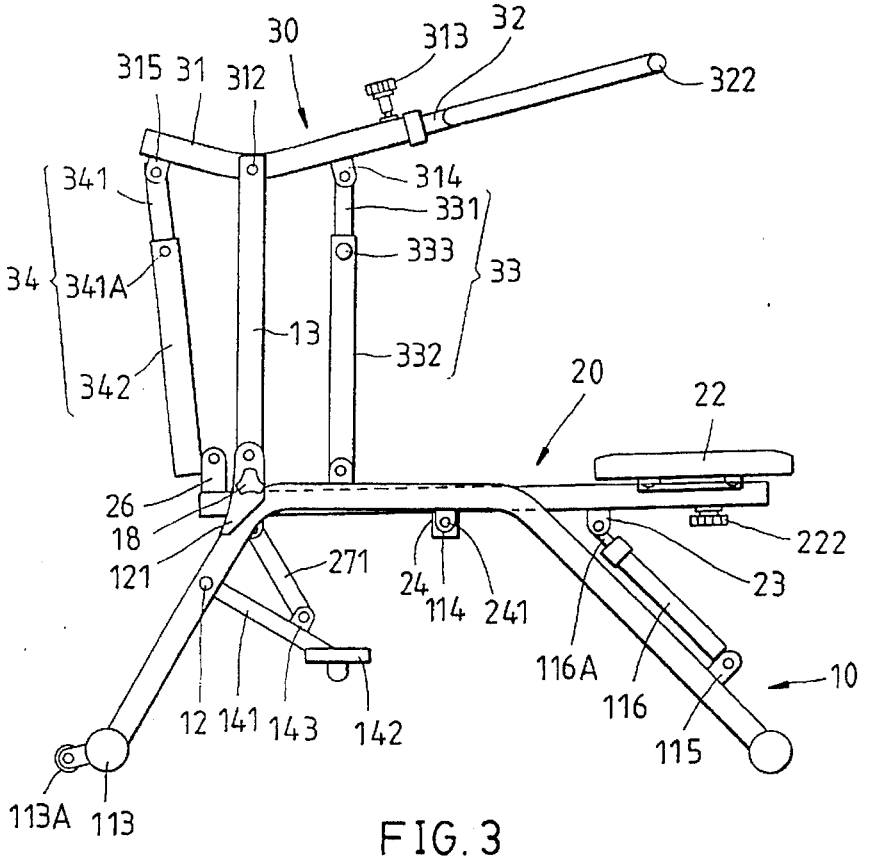
FIG. 3 shows a front plan view of the present invention.
Figure 4:
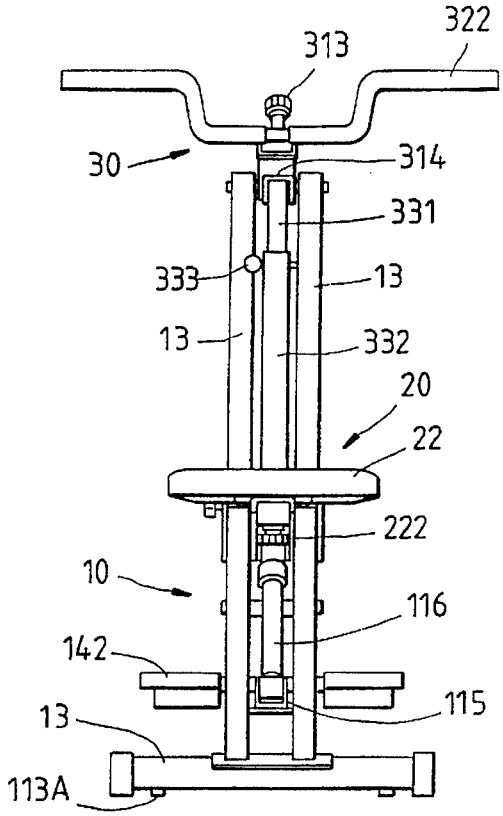
FIG. 4 shows a side plan view of the present invention.
Figure 5:
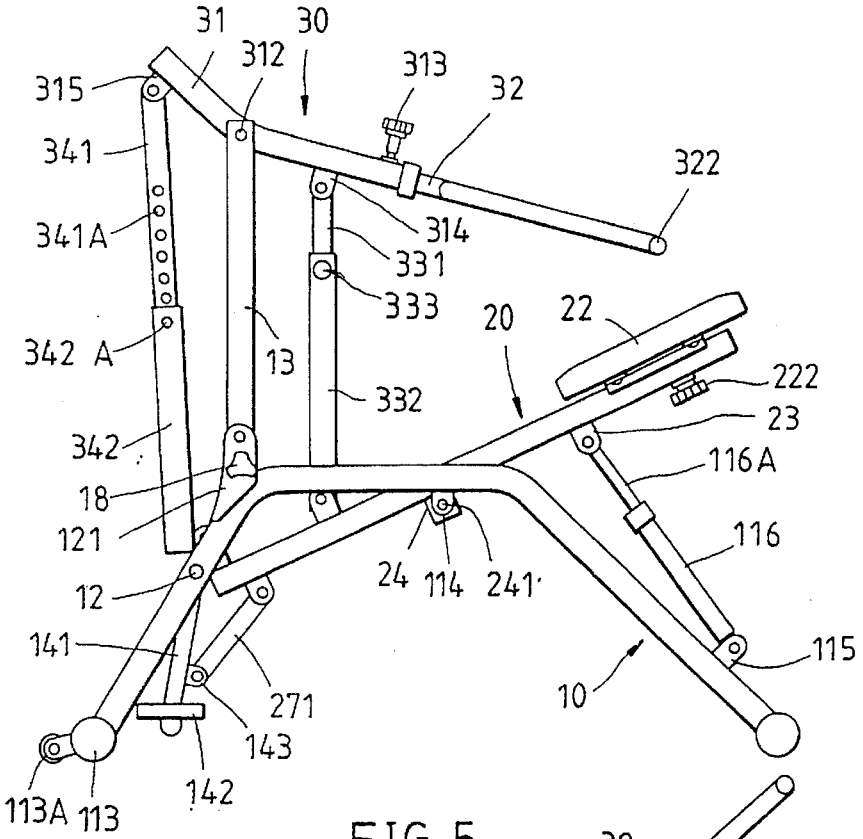
FIG. 5 shows a schematic view of the present invention at work.

As illustrated in FIGS. 3–5, an exerciser is seated on the seat 22, with his or her hands holding the handle 322 and with his or her feet treading the pedals 142. Thereafter, the pedals 142 are trodden forward to actuate the shaft 241 of the loading frame 20 to turn aside via the connection rods 141 and 271. In the meantime, the handle 322 is moved downwards to actuate the frame rod 13 to turn on the-shaft 312 acting as a fulcrum. When the actuating rod 32 is exerted on by a force, the second driving rod 34 remains in the sliding state. On the other hand, when the handle 322 is let go, the shaft 241 of the loading frame 20 is caused to swivel in a reverse direction by the weight of the exerciser sitting on the seat 22, so as to return to a horizontal state. In the meantime, the pedals 142 are caused by the connection rods 271 and 141 to rise along with the feet so as to imitate the horse-riding exercise.

Figure 6:
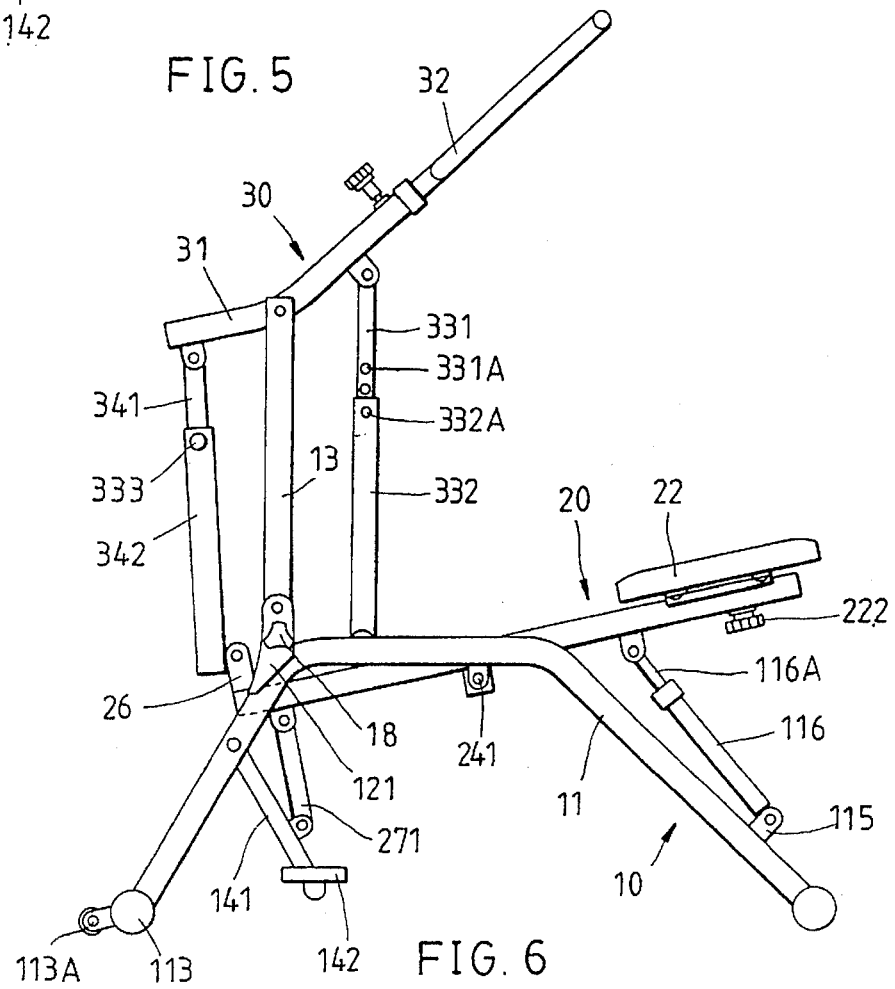
FIG. 6 shows another schematic view of the present invention at work.

As illustrated in FIG. 6, the fastening pin 333 of the first driving rod 33 is removed to insert into the through hole 341A of the second driving rod 34 so as to fix the second driving rod 34. The exerciser is seated on the seat 22, with both hands holding the handle 322. As the handle 322 is raised, the front end of the curve rod 31 is caused to displace upwards on the shaft 312 acting as a fulcrum while the rear end of the curve rod 31 is caused to swing downwards. In the meantime, the loading frame 20 is actuated by the second driving rod 34 to turn downwards on the shaft 241 so as to cause another end of the seat 22 to turn upwards against the body weight W. The first driving rod 33 remains in a free sliding state in view of the fact that the inner tube 331 and the outer tube 332 of the first driving rod 33 are not fixed. When the handle 322 is let go in a reverse direction, the damping of the air cylinder set 116 is gradually released. In the meantime, the loading frame 20 is caused to turn in a reverse direction on the shaft 241 so as to return to its original state. As a result, a pushing exercise and a lifting exercise are brought about.

Figure 7:
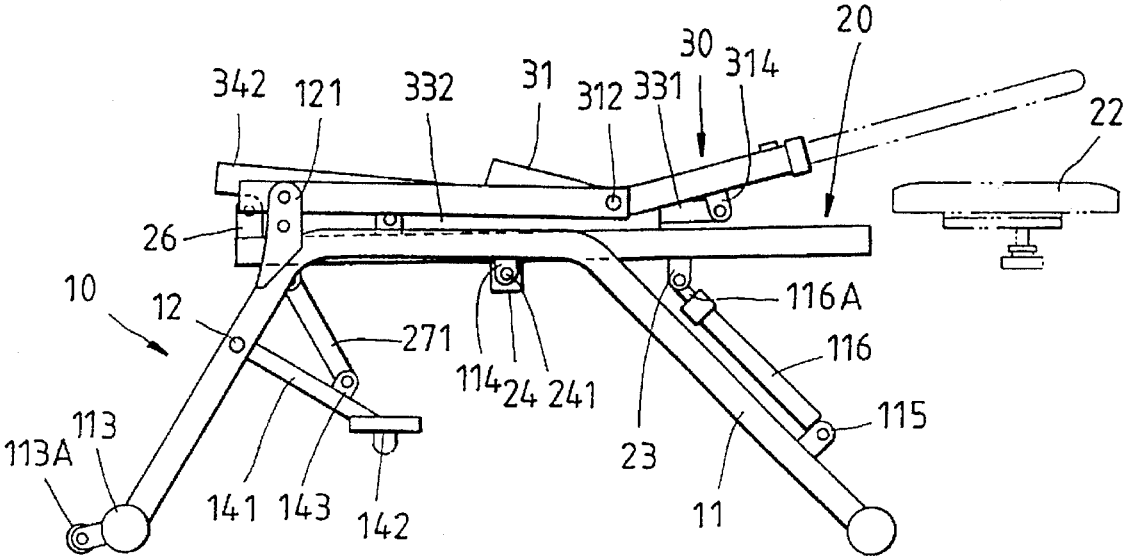
FIG. 7 is a schematic view illustrating the folding of the present invention.

As shown in FIG. 7, the exercise machine of the present invention can be made compact by disengaging first the movable member 18 located under the fastening plate 121 so as to enable the frame rod 13 to be folded. In the meantime, the actuating rod 32 can be disengaged with the curve rod 31 so as to facilitate the storage and the transportion of the exercise machine of the present invention.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A multipurpose exercise machine comprising:

a main frame composed of two arcuate frames and two frame rods;

a loading frame provided with a seat fastened therewith and two pedals fastened pivotally therewith, said loading frame fastened pivotally with said main frame; and an operation frame comprising a curve rod fastened pivotally with said frame rods, a first length adjustable driving rod and a second length adjustable driving rod, with said first driving rod and said second driving rod being pivotally fastened at respective first ends thereof with said loading frame and at respective second ends there of to said operation frame, said curve rod provided at one end thereof with an actuating rod fastened therewith, wherein said first and second length adjustable driving rods comprise means for enabling said multipurpose exercise machine to be adjusted for use for different exercises including horse-riding type exercises and arm building exercises.

2. The exercise machine as defined in claim 1, wherein said first driving rod and said second driving rod are respectively composed of an outer tube and an inner tube, with said inner tube having a plurality of through holes, and with said outer tube having a locating hole engageable with a fastening pin.

3. The exercise machine as defined in claim 1, wherein said pedals are pivoted to said main frame by means of a connection rod, with said connection rod being fastened pivotally with said loading frame by means of a connection rod.

4. The exercise machine as defined in claim 1, wherein said loading frame is provided with a slot in which a seat is mounted movably, with said seat being provided in a bottom thereof with a locating rod located adjustably in said slot.

5. The exercise machine as defined in claim 1, wherein said two arcuate frames of said main frame are parallel to each other and are separated from each other by a predetermined distance for mounting pivotally thereon said loading frame.

6. The exercise machine as defined in claim 1, wherein said actuating rod is provided at one end thereof with a plurality of through holes; and wherein said curve rod is provided at one end thereof with a locating screw fastened pivotally therewith, with said locating screw being engageable with one of said through holes of said actuating rod.

7. A multi purpose exercise machine comprising a main frame comprising two arcuate frames and two frame rods; said frame rods having a first upper pivot point, a loading frame including a seat and pedals pivotally attached to said loading frame, said loading frame being pivotally attached to said main frame at a second lower pivot point;

an operation frame comprising a curved rod, said curved rod being pivotally fastened with said frame rods at said first upper pivot point;

a first length adjustable driving rod which is intended to adjust the exercise machine for use in doing horse-riding type exercise and a second length adjustable driving rod which is intended to adjust the exercise machine for use in doing arm building exercises, each having first and second ends, said first and second length adjustable driving rods being pivotally fastened with said loading frame at their respective first ends and pivotally fastened at their respective second ends to said operation frame, and;

wherein both ends of said first driving rod are each pivotally attached to said operation frame and loading frame on one side of said upper an lower pivot points and both of the ends of said second driving rod are each pivotally attached to said operation frame and said loading on the opposite side of said upper and lower pivot points from said first driving rod.

* * * * *